US012649955B2

(12) United States Patent
Oda et al.

(10) Patent No.: US 12,649,955 B2
(45) Date of Patent: Jun. 9, 2026

(54) METHOD FOR MANUFACTURING LOW-PHOSPHORUS MOLTEN STEEL

(71) Applicant: JFE STEEL CORPORATION, Tokyo (JP)

(72) Inventors: Nobuhiko Oda, Tokyo (JP); Masanori Tanno, Tokyo (JP); Rei Yamada, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 477 days.

(21) Appl. No.: 18/022,802

(22) PCT Filed: Aug. 23, 2021

(86) PCT No.: PCT/JP2021/030769
§ 371 (c)(1),
(2) Date: Feb. 23, 2023

(87) PCT Pub. No.: WO2022/054555
PCT Pub. Date: Mar. 17, 2022

(65) Prior Publication Data

US 2023/0313330 A1 Oct. 5, 2023

(30) Foreign Application Priority Data

Sep. 10, 2020 (JP) ..... 2020-151788

(51) Int. Cl.
*C21C 7/064* (2006.01)
*C21C 5/54* (2006.01)

(52) U.S. Cl.
CPC ..... *C21C 7/064* (2013.01); *C21C 5/54* (2013.01); *C21C 2300/08* (2013.01)

(58) Field of Classification Search
CPC ..... C21C 7/064; C21C 5/54; C21C 2300/08; C21C 1/02; C21C 7/076; Y02P 10/20; Y02P 40/40
(Continued)

(56) References Cited

U.S. PATENT DOCUMENTS 5,868,817 A 2/1999 Yano et al.
6,077,324 A 6/2000 Fritz
(Continued)

FOREIGN PATENT DOCUMENTS

CN 102312033 A 1/2012
CN 102766729 A 11/2012
(Continued)

OTHER PUBLICATIONS

JP2010013674A Translation (Year: 2010).*
(Continued)

*Primary Examiner* — Danielle M. Carda

(57) ABSTRACT

A method for efficiently manufacturing low-phosphorus molten steel by use of a steelmaking electric furnace, in which slag resulting from melting a solid iron source is effectively separated from molten steel, and thus a unit consumption of lime required to reduce a phosphorus content in the molten steel is reduced. The method includes: charging a solid iron source and an optional molten iron source and melting and heating these raw materials by using electric energy; partly or entirely removing slag generated during the melting; performing dephosphorization by adding dephosphorization flux; and tapping low-phosphorus molten steel thus refined, and in the method, a slag composition ratio being $[CaO]/([SiO_2]+[Al_2O_3])$ of the slag to be removed is adjusted to be not less than 0.25 and not more than 0.70.

4 Claims, 2 Drawing Sheets

(58) Field of Classification Search
USPC ..... 75/10.58, 10
See application file for complete search history.

(56) References Cited

U.S. PATENT DOCUMENTS

| | | | |
|---|---|---|---|
| 2014/0069235 | A1 | 3/2014 | Ikeno et al. |
| 2015/0000470 | A1 | 1/2015 | Iwaki et al. |
| 2021/0355554 | A1 | 11/2021 | Zhu et al. |

FOREIGN PATENT DOCUMENTS

| | | | | |
|---|---|---|---|---|
| CN | 103649341 | A | | 3/2014 |
| CN | 104053794 | A | | 9/2014 |
| CN | 104404194 | A | | 3/2015 |
| CN | 108085449 | A | | 5/2018 |
| CN | 111635977 | A | | 9/2020 |
| JP | H05-117735 | A | | 5/1993 |
| JP | H07-179920 | A | | 7/1995 |
| JP | H08-120321 | A | | 5/1996 |
| JP | H08-225880 | A | | 9/1996 |
| JP | 10152714 | A | * | 6/1998 |
| JP | H10-152714 | A | | 6/1998 |
| JP | 2001-182924 | A | | 7/2001 |
| JP | 2001-303118 | A | | 10/2001 |
| JP | 2010013674 | A | * | 1/2010 |
| JP | 2013-001915 | A | | 1/2013 |
| JP | 2013-167010 | A | | 8/2013 |
| JP | 2017-166021 | A | | 9/2017 |
| KR | 10-2017-0078818 | A | | 7/2017 |

OTHER PUBLICATIONS

JP H 10-152714A (Year: 1998).*

Jan. 25, 2024 extended Search Report issued in European Patent Application No. 21866515.6.

May 15, 2024 Office Action issued in Korean Patent Application No. 10-2023-7011475.

Dec. 12, 2024 Office Action issued in Chinese Patent Application No. 202180052699.4.

Nov. 2, 2021 International Search Report issued in International Patent Application No. PCT/JP2021/030769.

Slag Atlas 2nd edition: Verlag Stahleisen, GmbH, 1995, pp. 105.

Jul. 21, 2025 Office Action issued in Chinese Patent Application No. 202180052699.4.

Liyi Yan, "Special Steel Library Modern Processes and Equipments using Electric Furnace", Metallurgical Industry Press, Sep. 30, 2011, pp. 44.

Jan. 22, 2026 Office Action issued in Chinese Patent Application No. 202180052699.4.

* cited by examiner

METHOD FOR MANUFACTURING LOW-PHOSPHORUS MOLTEN STEEL

TECHNICAL FIELD

The present invention relates to a method for manufacturing low-phosphorus molten steel.

BACKGROUND ART

A refining step of molten steel using a steelmaking electric furnace typically employs a method for controlling a phosphorus concentration in molten steel involving supplying the steelmaking electric furnace with electric energy to melt a raw material containing a solid iron source followed by an oxygen source and dephosphorization flux. Dephosphorization ability ($L_p$) of slag in the molten steel refining step is described by using, for example, a composition (% T.Fe) of an iron (Fe) component contained in the slag, a composition (% CaO) of a calcium oxide (CaO) component contained therein, and a slag temperature T (° C.) as in a general formula (1) shown below, where T.Fe denotes total iron.

[Mathematical Formula 1]

$$\log Lp = 2.5\log(\%\ T.\mathrm{Fe}) + a(\%\ \mathrm{CaO}) + \frac{b}{T+273} + c \quad (1)$$

In the above general formula (1), coefficients a, b, and c are numerical values obtained empirically and vary depending on the shape of a steelmaking electric furnace used and conditions for agitating molten steel. Typically, as the slag temperature T (° C.) is lower or the composition (% T.Fe) of an iron component contained in slag is higher, higher dephosphorization ability ($L_p$) of the slag can be maintained. Furthermore, as the composition (% CaO) of calcium oxide (CaO) in slag is higher, higher dephosphorization ability ($L_p$) in the slag can be maintained. Consequently, by decreasing the slag temperature T (° C.) and increasing the composition (% CaO) of calcium oxide (CaO) in slag, molten steel having a reduced phosphorus concentration, namely, low-phosphorus molten steel can be manufactured.

In a refining step of steel in a steelmaking electric furnace, however, the minimum temperature of molten steel is determined by the concentration of a carbon component contained in steel to be manufactured. It is, therefore, difficult to improve the dephosphorization ability ($L_p$) of slag by decreasing the slag temperature T (° C.) only. Furthermore, in a refining step of steel in a steelmaking electric furnace, excessive combustion of iron leads to a decrease in iron yield and thus is undesirable. It is thus undesirable to increase the composition (% T.Fe) of an iron (Fe) component so as to improve the dephosphorization ability ($L_p$) of slag. For these reasons, in the refining step of steel in a steelmaking electric furnace, the composition (% CaO) of calcium oxide (CaO) in slag is increased as a mainstream way of ensuring the dephosphorization ability ($L_p$) of slag.

Slag generated in a steelmaking electric furnace contains components such as, besides calcium oxide (CaO) and iron oxide (FeO, $Fe_2O_3$) metallic oxides of silicon (Si), aluminum (Al), manganese (Mn), chromium (Cr), nickel (Ni), and so on derived from a solid iron source, and magnesium oxide (MgO) separately added for protection of a furnace body of the steelmaking electric furnace. In order to maintain the composition (% CaO) of calcium oxide (CaO) contained in slag at a high ratio, it is required that calcium oxide (CaO) be added to the slag in consideration of inevitable inclusion of the above-described metallic oxides in the slag generated in the iron refining step.

However, adding a large amount of calcium oxide (CaO) to slag causes a generation of an excessive amount of slag. Furthermore, a large amount of lime needs to be prepared as a lime source to add a large amount of calcium oxide (CaO) to slag, disadvantageously increasing manufacturing costs. In particular, due to the extremely poor quality of solid iron sources in recent years, increased amounts of the above-described metallic oxides are inevitably included in slag, thus significantly increasing the unit consumption of lime required.

To address this issue, the following methods have been proposed as techniques for reducing the lime unit consumption while securing the dephosphorization ability ($L_p$) of slag. For example, Patent Literature 1 discloses a method for manufacturing a precursor of stainless steel and proposes that, in an initial manufacturing step, an iron carrier be decarbonized and dephosphorized to a considerable extent by means of oxygen, and then a slag product be separated therefrom. The above-described method for manufacturing a precursor of stainless steel includes melting an iron carrier followed by tapping once and conducting dephosphorization in a different steelmaking electric furnace, so that molten steel is separated from inevitably included metallic oxides, and thus the unit consumption of calcium oxide (CaO) used is reduced.

Patent Literature 2 proposes a refining method for efficiently subjecting hot metal not desiliconized beforehand to desiliconization and dephosphorization. The refining method is a dephosphorization method of molten iron involving conducting, in one converter, the desiliconization followed by slag removal and then dephosphorization. In this dephosphorization method, a (CaO)/($SiO_2$) weight ratio of the slag after the desiliconization is set to not less than 0.3 and not more than 1.3 thus to secure such fluidity that the slag can be removed.

Patent Literature 3 proposes a refining method in which molten steel containing 1.0 to 2.0 mass % Cr is dephosphorized without substantial use of an auxiliary raw material including $CaF_2$. In this refining method, slag draining or slag removal is performed plural times during refining in a steelmaking electric furnace so that a yield of an added alloy is improved.

CITATION LIST

Patent Literature

Patent Literature 1: JP-H08-225880A
Patent Literature 2: JP-H10-152714A
Patent Literature 3: JP-2013-1915A

Non Patent Literature

Non Patent Literature 1: Slag Atlas 2nd edition: Verlag Stahleisen GmbH, (1995)

SUMMARY OF INVENTION

Technical Problem

The above-described conventional techniques present the following problems. That is, in the manufacturing method described in Patent Literature 1, since a considerable amount of heat is dissipated in the tapping step, it is required to compensate for the dissipated heat by separately supplying electric energy or combustion heat energy to a steelmaking electric furnace.

Further, the refining method described in Patent Literature 2 reports findings in melting, in a converter-type refining furnace, an iron source having a relatively high carbon concentration and a low melting point of molten steel. In an electric furnace, however, manufacturing is performed by melting a solid iron source having a high melting point, and thus it is typically required that a molten steel temperature be set to 1500° C. or higher. Because of this, in the above-described refining method, molten steel present inside the refining furnace is largely different in fluidity from slag coexisting with the molten steel. This makes it unable to utilize the findings that the $(CaO)/(SiO_2)$ weight ratio of slag after desiliconization is set to be in a particular range to secure such fluidity that the slag can be removed.

The method described in Patent Literature 3 has such a disadvantage that slag having a $CaO/SiO_2$ ratio of not less than 1.5 is so low in viscosity that it can hardly be separated from molten steel, and thus the molten steel might flow out at the time of slag removal, decreasing an iron yield.

The present invention is made in light of the foregoing circumstances, and one of the objects thereof is to provide a method for manufacturing low-phosphorus molten steel in which slag resulting from melting a solid iron source is effectively separated from molten steel, and thus a unit consumption of lime required to reduce a phosphorus content in the molten steel is reduced, so that low-phosphorus molten steel can be efficiently manufactured by use of a steelmaking electric furnace.

Solution to Problem

As a result of having repeated various experiments for solving the above-described problems, the inventors have made the following findings. That is, with attention focused on the fact that a solid fraction and a viscosity of slag generated in a steelmaking electric furnace at 1500° C. or higher largely vary depending on the composition of the slag, a solid iron source and, optionally, a molten iron source are charged, and in a step of partly or entirely removing slag generated during melting of these raw materials using electric energy, a slag composition ratio C/(S+A) of the slag to be removed is adjusted to be in a range of not less than 0.25 and not more than 0.70, and thus a unit consumption of lime required to reduce a phosphorus content in molten steel is reduced, so that low-phosphorus molten steel can be efficiently manufactured by use of a steelmaking electric furnace. Here, the slag composition ratio C/(S+A) is determined by dividing a CaO concentration (C) by a sum of an $SiO_2$ concentration (S) and an $Al_2O_3$ concentration (A) on a mass basis in the slag.

The present invention has been made based on the above-described findings and can be summarized as below. That is, the present invention relates to a method for manufacturing low-phosphorus molten steel including: a first step of charging a solid iron source and, optionally, a molten iron source and melting and heating these raw materials by using electric energy; a second step of partly or entirely removing slag generated during the melting; a third step of, after the second step, performing dephosphorization by adding dephosphorization flux; and a fourth step of tapping low-phosphorus molten steel thus refined. In the method, the slag composition ratio C/(S+A) of the slag to be removed in the second step is adjusted to be in the range of not less than 0.25 and not more than 0.70.

The method for manufacturing low-phosphorus molten steel according to the present invention can conceivably provide a more preferred solution by including, for example:

(a) adjusting, in the third step, the slag composition ratio C/(S+A) to be in the range of not less than 0.80 and not more than 2.80; and (b) performing the tapping, in the fourth step, while the low-phosphorus molten steel is partly left in a furnace, and additionally charging a solid iron source and, optionally, a molten iron source so that molten steel is continuously manufactured.

Advantageous Effect of Invention

According to the present invention, slag resulting from melting a solid iron source is effectively separated from molten steel, and thus a unit consumption of lime required to reduce the phosphorus content in the molten steel is reduced, so that low-phosphorus molten steel can be efficiently manufactured by a steelmaking electric furnace.

DESCRIPTION OF EMBODIMENTS

First Embodiment

A description will be given of the idea that led to the findings of the present invention. In manufacturing molten steel in a steelmaking electric furnace, a solid iron source such as scrap, reduced iron, hot metal manufactured by a different process, or the like is used. Components contained in scrap or hot metal, such as silicon (Si), manganese (Mn), chromium (Cr), and aluminum (Al), turn into oxides by reacting with oxygen supplied to the steelmaking electric furnace during the melting of the scrap and the solid iron source, and these oxides form slag.

Typically, scrap containing aluminum (Al) or reduced iron containing a small percent of an oxide of aluminum is used as a solid iron source for manufacturing molten steel. Thus, slag generated in a steelmaking electric furnace contains particularly aluminum oxide ($Al_2O_3$) at a high concentration among the oxides. In evaluating the dephosphorization ability ($L_p$) of slag or a slag removing property, therefore, it is required to design slag in consideration not only of a calcium oxide (CaO) concentration and a silicon dioxide ($SiO_2$) concentration but also of an aluminum oxide ($Al_2O_3$) concentration.

A technical disadvantage in removing slag from a steelmaking electric furnace is that molten steel trapped in the slag is removed from the steelmaking electric furnace at the same time as the removal of the slag therefrom, resulting in a decrease in the iron yield. In order to improve the slag removing property without decreasing the iron yield, it is important to decrease the bulk density of the slag by causing slag foaming as much as possible so that the density of the molten steel is increased relative to the bulk density of the slag, thus causing gravity separation between them.

From this viewpoint, the inventors have defined, as the slag composition ratio C/(S+A), a quotient $CaO/(SiO_2+Al_2O_3)$ obtained by dividing a CaO concentration (C) by a sum of an $SiO_2$ concentration (S) and an $Al_2O_3$ concentration (A) in the slag to be removed. Here, C, S, and A in the slag composition ratio C/(S+A) denote a CaO concentration, a $SiO_2$ concentration, and an $Al_2O_3$ concentration, respectively.

The inventors have found that, in the method for manufacturing low-phosphorus molten steel in this embodiment, a solid iron source and, optionally, a molten iron source are charged in a steelmaking electric furnace, and in the second step of partly or entirely removing slag generated during the melting of these raw materials using electric energy, the slag composition ratio C/(S+A) of the slag to be removed is adjusted to be in the range of not less than 0.25 and not more than 0.70, and thus a viscosity of the slag can be appropriately controlled to promote the foaming of the slag. They have also found a method for effectively manufacturing low-phosphorus molten steel by performing intermediate slag removal under a condition where the foaming of the slag can be promoted.

Figure 1:
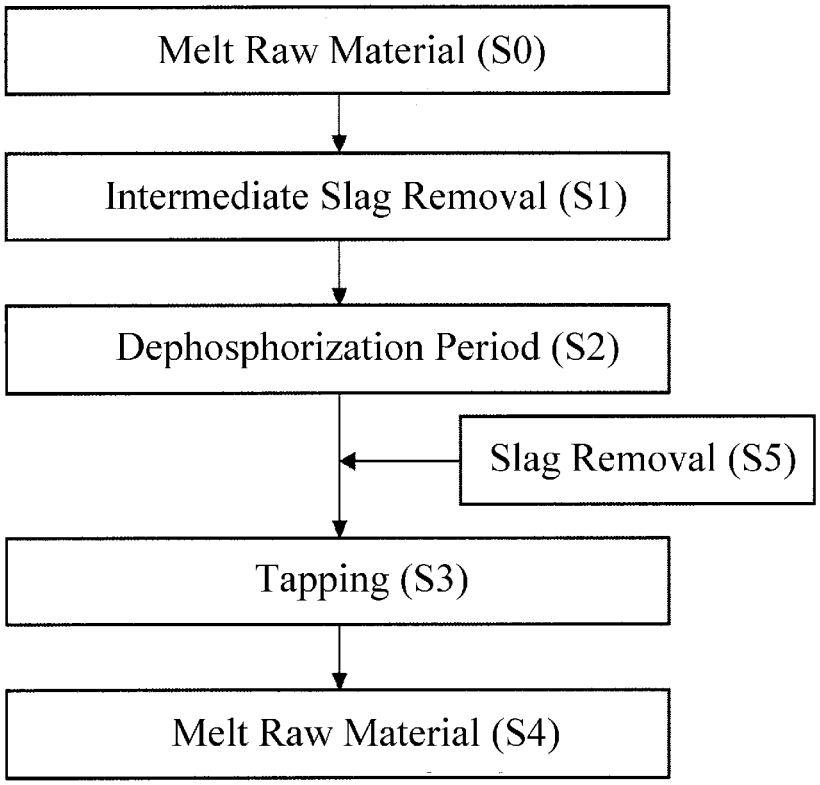
FIG. 1 is a flowchart showing a basic configuration of a method for manufacturing low-phosphorus molten steel according to an embodiment of the present invention.

FIG. 1 is a flowchart showing a basic configuration of a method for manufacturing low-phosphorus molten steel according to the first embodiment of the present invention. As shown in FIG. 1, the method for manufacturing low-phosphorus molten steel according to this embodiment includes a first step (S0) of melting a raw material such as a solid iron source, a second step (S1) of performing intermediate slag removal in which slag generated during the melting of the raw material is partly or entirely removed, a third step (S2) of performing dephosphorization, and a fourth step (S3) of tapping low-phosphorus molten steel thus refined. Moreover, the method for manufacturing low-phosphorus molten steel in this embodiment further includes, subsequent to the fourth step of tapping (S3), a step (S4) of melting a raw material, and a step (S5) of removing slag.

The first step (S0) involves charging a solid iron source and, optionally, a molten iron source in a steelmaking electric furnace and melting and heating these raw materials by using electric energy. In the steelmaking electric furnace, only the solid iron source such as scrap or reduced iron may be charged, or the molten iron source may be optionally charged in addition to the solid iron source. Furthermore, the molten iron source may use molten steel obtained by melting solid iron in a different process or reuse molten steel manufactured in a process preceding the first step and left in the steelmaking electric furnace after tapping molten steel.

The electric energy supplied to melt the solid iron source and the optionally-charged molten iron source and to heat these raw materials may use the electric energy only, or supplementally use thermal energy such as metal combustion heat or carbon combustion heat in addition to the electric energy. The solid iron source charged in the steelmaking electric furnace is melted by the electric energy, thus generating molten steel and slag. The temperature in the steelmaking electric furnace increases to 1500° C. or higher after the melting. The slag temperature also increases to 1500° C. or higher with the temperature rise of the molten steel.

Next, the second step (S1) involves partly or entirely removing slag generated during the melting of the charged solid iron source and the optionally-charged molten iron source in the steelmaking electric furnace. That is, in the second step, intermediate slag removal is performed so that slag generated in the first step is partly or entirely removed. In the method for manufacturing low-phosphorus molten steel in this embodiment, by appropriately controlling the foaming state of the slag in this intermediate slag removal step, it is made possible to remove the generated slag without decreasing an iron yield.

In the second step of the method for manufacturing low-phosphorus molten steel in this embodiment, a value of $CaO/(SiO_2+Al_2O_3)$ representing a slag composition ratio is set to be in a particular range to promote the slag foaming and improve the dephosphorization ability ($L_p$) of the slag. The slag composition ratio is represented by C/(S+A) and determined by dividing the CaO concentration (C) by a sum of the $SiO_2$ concentration (S) and the $Al_2O_3$ concentration (A) on a mass basis in the slag.

In particular, slag that maintains a high value of the slag composition ratio C/(S+A) to retain the dephosphorization ability ($L_p$) has a small viscosity and hardly causes slag foaming, and therefore iron yield decreases at the removal of the slag. On the other hand, when the composition ratio C/(S+A) of slag is maintained at a low value, the slag mostly turns into a solid phase or has a high viscosity due to its extremely high $SiO_2$ concentration. When maintaining a low slag composition ratio C/(S+A), therefore, the slag has such a property that slag foaming is unlikely to be promoted. As a result, iron yield decreases at the time of slag removal.

The inventors have conducted vigorous studies to solve this issue and have found that, by setting a value of C/(S+A) representing the slag composition ratio to not less than 0.25 and not more than 0.70, the slag viscosity is appropriately controlled to promote slag foaming. Prior to the present invention, the inventors conducted a physicochemical study on a proper range where slag foaming can be promoted in the manufacture of low-phosphorus molten steel.

Figure 2:
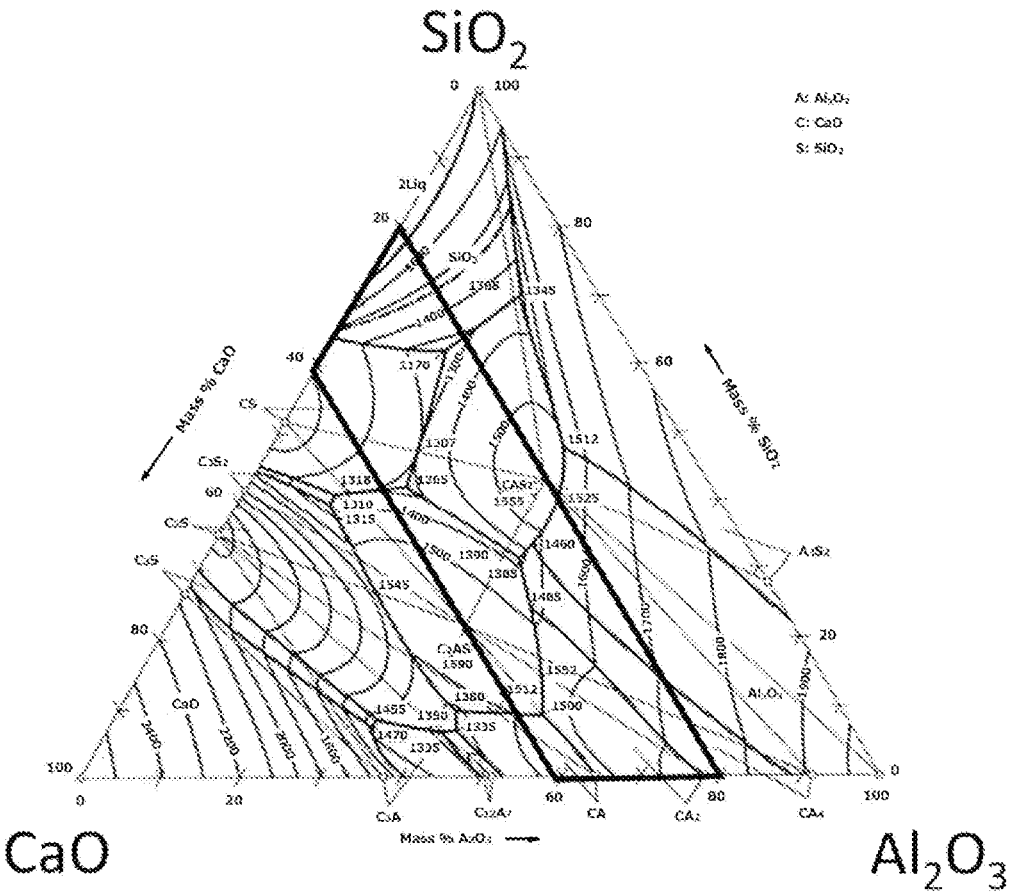
FIG. 2 is a $CaO—SiO_2—Al_2O_3$ ternary phase diagram showing a proper range enabling slag foaming to be promoted.

FIG. 2 is a $CaO—SiO_2—Al_2O_3$-based ternary phase diagram showing a proper range where slag foaming can be promoted. In FIG. 2, a region enclosed with a frame is where slag foaming can be promoted. That is, in FIG. 2, the region enclosed with the frame indicates a region in which a value of C/(S+A) is not less than 0.25 and not more than 0.70. Note that FIG. 2 is a ternary phase diagram based on a $CaO—SiO_2—Al_2O_3$-based ternary phase diagram shown in Non-Patent Literature 1 and additionally including, based on experimental results, the proper range where slag foaming can be promoted.

In FIG. 2, the ratio of a solid phase can be easily controlled under the condition of the slag composition ratio of $CaO—SiO_2—Al_2O_3$-based ternary components determined by the region enclosed with the frame. Thus, increasing the viscosity of slag with the above-described slag composition ratio can promote the foaming of the slag generated during the melting of a solid iron source, and so on.

As described above, in the method for manufacturing low-phosphorus molten steel by using a steelmaking electric furnace, to promote the slag foaming of slag generated during the melting of a solid iron source and so on not only improves a slag removing property but also obtains such secondary effects that the energization efficiency in the steelmaking electric furnace and a furnace body protection ability by slag coating can be enhanced.

In order to adjust the value of the slag composition ratio C/(S+A) to not less than 0.25 and not more than 0.70, it is required to calculate the mass of a lime source including calcium oxide (CaO) to be charged in the steelmaking electric furnace. In order to calculate the mass of the lime source to be charged in the steelmaking electric furnace, it is desirable to grasp beforehand the masses of silicon (S1) and aluminum (Al) contained in a solid iron source to be charged in the steelmaking electric furnace. Furthermore, the mass of the lime source to be charged in the steelmaking electric furnace may have a value derived from an empirical rule based on the type of the solid iron source, the type of a molten iron source, the melting temperature of a raw material, or the like.

In the second step, the method of removing the slag present in the steelmaking electric furnace out of a system of the steelmaking electric furnace typically uses a method of removing the slag out of the system by tilting the steelmaking electric furnace. In the second step, the slag present in the steelmaking electric furnace may be entirely or partly removed from the steelmaking electric furnace. Typically, the slag present in the steelmaking electric furnace should be removed as much as possible out of the system, i.e., out of the furnace. In a case, however, where slag foaming is not promoted, granular iron often remains in the slag and is removed out of the system with the removal of the slag. For this reason, in the case where slag foaming is not promoted, it is preferable to remove a part of the slag. The steelmaking electric furnace may have a relatively small internal capacity, and thus the slag may be partly removed out of the system of the steelmaking electric furnace without tilting the steelmaking electric furnace. Even in such a case, it is desirable that not less than 40% (mass ratio) of the total amount of the slag generated in the furnace be removed so as to reduce the amount of dephosphorization flux to be added in the subsequent third step.

Moreover, the third step (S2) is a step of adding dephosphorization flux in the steelmaking electric furnace from which the slag has been entirely or partly removed in the above-described second step (S1) so as to eliminate phosphorus in molten steel. That is, in the third step, after the slag removal carried out in the above-described second step, dephosphorization is performed by adding the dephosphorization flux in the steelmaking electric furnace.

In the third step, the dephosphorization flux is added to the steelmaking electric furnace to increase the concentration (S2) of calcium oxide (CaO) in the slag. By the third step, phosphorus in the molten steel can be eliminated. In the third step, the amount of the dephosphorization flux to be added may be set such that the value of the slag composition ratio C/(S+A) is set to be in a particular range. In the third step, the dephosphorization flux used for the dephosphorization is not particularly limited as long as it contains calcium oxide (CaO) and may be lime or pre-melt flux.

In this case, a refining reaction may be promoted by performing thermal compensation through the energization of the steelmaking electric furnace or by blowing gas into the steelmaking electric furnace so as to cause agitation. The phosphorus concentration in low-phosphorus molten steel obtained by the method for manufacturing low-phosphorus molten steel in this embodiment varies depending on the type of an iron and steel material (a type of steel) used. While the phosphorus concentration in low-phosphorus molten steel is typically not more than 0.030 mass %, this approach can be applied to a case of manufacturing molten steel having a phosphorus concentration lower than the value thereof calculated from the total amount of added phosphorus determined based on a solid iron source and an auxiliary raw material charged and a substance remaining in the above-described furnace. Here, in order to further reduce a phosphorus concentration in molten steel, it is desirable to set a value of the slag composition ratio C/(S+A) to be in a predetermined range.

The fourth step (S3) involves tapping the low-phosphorus molten steel from which phosphorus has been eliminated by dephosphorization in the above-described third step. That is, in the fourth step, there is tapped the molten steel from which phosphorus has been eliminated and that is obtained in the third step. In the method for manufacturing low-phosphorus molten steel in this embodiment, low-phosphorus molten steel can be manufactured using a solid iron source as a raw material by adopting the first to fourth steps. That is, in the method for manufacturing low-phosphorus molten steel in this embodiment, low-phosphorus molten steel can be manufactured by adopting the first to fourth steps as one unit. In this case, in order to improve the energization efficiency of the steelmaking electric furnace, molten steel in the furnace may be made to partly remain in the furnace without being entirely tapped. In the fourth step, it is possible to continuously manufacture low-phosphorus molten steel by using the molten steel remaining in the steelmaking electric furnace as a molten iron source. That is, the molten steel remaining in the steelmaking electric furnace in the step (S4) of melting the raw material may be used as a molten iron source to be charged in the steelmaking electric furnace in the first step in a new manufacturing unit.

Moreover, in a case (S4) of continuously manufacturing low-phosphorus molten steel by using the method for manufacturing low-phosphorus molten steel in this embodiment, amounts of silicon and an oxide of aluminum remaining in the system are increased, and thus it is possible to benefit considerably from this method. In the method for manufacturing low-phosphorus molten steel in this embodiment, low-phosphorus molten steel can be continuously manufactured by directly using molten steel in a melted and heated state, hardly causing considerable heat loss.

As thus described, according to the method for manufacturing low-phosphorus molten steel in the first embodiment, by adjusting the slag composition ratio of slag generated during the melting of a solid iron source to promote the slag foaming and thus effectively separate the slag from molten steel, the unit consumption of lime required to reduce the phosphorus content in the molten steel is reduced, and as a result, low-phosphorus molten steel can be efficiently manufactured by using the steelmaking electric furnace.

Second Embodiment

Next, a description is given of a method for manufacturing low-phosphorus molten steel according to a second embodiment of the present invention. The method for manufacturing low-phosphorus molten steel in the second embodiment is characterized in that, in the third step (S2) of the method for manufacturing low-phosphorus molten steel in the first embodiment, the slag composition ratio C/(S+A) is adjusted to be in the range of not less than 0.80 and not more than 2.80.

In the method for manufacturing low-phosphorus molten steel in the second embodiment, to further reduce the phosphorus concentration in molten steel to be manufactured, the value of the slag composition ratio C/(S+A) in the third step should be set not less than 0.80. When the value of the slag composition ratio C/(S+A) is not less than 0.80, it is possible to obtain low-phosphorus molten steel without excessively oxidizing iron. This consequently improves an iron yield and thus is preferable.

On the other hand, to further reduce the phosphorus concentration in molten steel to be manufactured, the value of the slag composition ratio C/(S+A) in the third step should be set not more than 2.80. When the value of the slag composition ratio C/(S+A) is not more than 2.80, a lime source, even if excessively added, neither turns into slag nor contributes to dephosphorization, failing to be removed from the system, which is preferable.

As thus described, according to the method for manufacturing low-phosphorus molten steel in the second embodiment, by adjusting the slag composition ratio of slag after dephosphorization in the third step of the method for manufacturing low-phosphorus molten steel, the unit consumption of lime required to reduce the phosphorus content in the molten steel can be reduced, so that low-phosphorus molten steel can be efficiently manufactured by using a steelmaking electric furnace.

Third Embodiment

A description is given of a method for manufacturing low-phosphorus molten steel according to the third embodiment of the present invention. The method for manufacturing low-phosphorus molten steel in this embodiment is characterized in that, in the fourth step of the first or second embodiment, tapping is performed while low-phosphorus molten steel is made to partly remain in the furnace (S3), and a solid iron source and an optional molten iron source are additionally charged, so that molten steel is continuously manufactured (S4).

In the method for manufacturing low-phosphorus molten steel in the third embodiment, molten steel is made to partly remain in a steelmaking electric furnace, so that low-phosphorus molten steel can be continuously manufactured. In this case, molten steel is made to partly remain in the steelmaking electric furnace, thus improving the energization efficiency of the steelmaking electric furnace. In the case of continuously manufacturing low-phosphorus molten steel (S4), amounts of oxides of silicon and aluminum remaining in the system are increased, and thus the benefit of this method can be considerably obtained. In this case, phosphorus in slag remaining in the furnace is also carried over to the subsequent step at the same time, and therefore it is desirable to partly remove the slag again before tapping to remove from the system (S5).

As thus described, according to the method for manufacturing low-phosphorus molten steel in the third embodiment, by performing tapping while partly leaving the refined low-phosphorus molten steel in the furnace and newly charging a solid iron source and, optionally, a molten iron source, molten steel can be continuously manufactured.

Other Embodiments

While having been described thus far with reference to the embodiments, the present invention is not limited to the foregoing embodiments. Various modifications within the technical scope of the present invention and understandable to those skilled in the art can be made to the configurations and details of the present invention. Furthermore, a system or an apparatus obtained by combining, in any way, different features included respectively in the embodiments is also encompassed within the technical scope of the present invention.

The present invention may be also applied to a system composed of a plurality of devices or to an individual apparatus. The present invention is applicable also to a case where an information processing program fulfilling a function according to the embodiments is supplied to a system or an apparatus and is executed by a processor built therein. A program installed on a computer or a medium storing the program for fulfilling the functions according to the present invention on the computer is also encompassed within the technical scope of the present invention.

EXAMPLES

Example 1

A 230-ton scale steelmaking electric furnace was adopted as a steelmaking electric furnace. Scrap and direct-reduced iron were charged in the steelmaking electric furnace. The temperature in the steelmaking electric furnace was set to 1500° C. and was increased at a predetermined heating rate so that the scrap and the direct-reduced iron were melted and heated. Intermediate slag removal was performed in which slag generated during the melting of the scrap and the direct-reduced iron was partly removed from the electric furnace. In a method for manufacturing low-phosphorus molten steel in Example 1, the value of the slag composition ratio C/(S+A) at the time of the intermediate slag removal was set to 0.34.

Molten steel generated during the melting of the scrap and the direct-reduced iron was subjected to dephosphorization by adding thereto calcium oxide as dephosphorization flux and sufficiently agitating a resulting mixture under predetermined conditions. The dephosphorization flux was added twice, i.e., during the melting of the scrap and so on (the first addition) and when the electric furnace temperature reached a set value (the second addition). Of 230 tons of molten steel after being subjected to dephosphorization, about 80 tons of molten steel was left in the electric furnace, and about 150 tons of molten steel was tapped to manufacture low-phosphorus molten steel. In the method for manufacturing low-phosphorus molten steel in Example 1, the slag composition ratio C/(S+A) after the dephosphorization was set to 1.20.

In Example 1, the slag composition ratio at the time of the intermediate slag removal (the second step) is used as a slag designing condition, while the slag composition ratio after dephosphorization (the third step) is used as a slag removal condition after dephosphorization, and these slag composition ratios are shown in Table 1. Table 1 shows the slag designing condition and slag removal condition used in Example 1.

For continuous evaluations, low-phosphorus molten steel that has the equal upper limit standard value of an amount of phosphorus was manufactured. The refined low-phosphorus molten steel was tapped four times.

The slag composition ratio changed during continuous operation but not to a considerable degree, and thus, with respect to the refined low-phosphorus molten steel, each average value of the slag composition ratios of the slag at the time of the intermediate slag removal and in a step after the dephosphorization were shown. Furthermore, in Example 1, in order to maximally reduce phosphorus carried into the steelmaking metal furnace, under all conditions, slag before tapping after the dephosphorization was partly removed so as to reduce the amount of phosphorus carried thereinto during the continuous operations.

Examples 2 to 5

Low-phosphorus molten steel was manufactured in a similar manner to Example 1 except that the slag composition ratio at the time of the intermediate slag removal in the second step was made to vary within the range of not less than 0.25 and not more than 0.70, and the slag composition ratio after dephosphorization in the third step was made to vary within the range of not less than 0.80 and not more than 2.80. Table 1 shows slag designing conditions and slag removal conditions used respectively in Examples 2 to 5.

Comparative Examples 1 to 5

In Comparative Examples 1 and 4, low-phosphorus molten steel was manufactured without carrying out the intermediate slag removal. Furthermore, in Comparative Examples 2, 3, and 5, low-phosphorus molten steel was manufactured in a similar manner to Example 1 except that, while the intermediate slag removal was carried out, the slag composition ratio at the time of intermediate slag removal was made to vary outside the range of not less than 0.25 and not more than 0.70. Table 1 shows slag designing conditions and slag removal conditions respectively in Comparative Examples 1 to 5.

TABLE 1

| Example Number | Intermediate slag removal | Average value of $CaO/(SiO_2 + Al_2O_3)$ At the time of intermediate slag removal | After dephosphorization |
|---|---|---|---|
| Example 1 | Performed | 0.34 | 1.20 |
| Example 2 | Performed | 0.50 | 1.13 |
| Example 3 | Performed | 0.58 | 0.75 |
| Example 4 | Performed | 0.40 | 1.98 |
| Example 5 | Performed | 0.30 | 3.20 |
| Comparative Example 1 | Not performed | — | 0.73 |
| Comparative Example 2 | Performed | 0.72 | 0.80 |
| Comparative Example 3 | Performed | 0.23 | 0.75 |
| Comparative Example 4 | Not performed | — | 1.18 |
| Comparative Example 5 | Performed | 1.02 | 1.18 |

Next, with respect to the slag designing condition and the slag removal condition in each of Examples 1 to 5 and Comparative Examples 1 to 5 shown in Table 1, the metal flowed out at the same time as the generation of slag was examined, and an influence thereof on an iron yield was evaluated. Moreover, a tapped phosphorus concentration (mass %) was measured and evaluated in view of a relationship with a lime unit consumption (kg/t), and a final evaluation based on these evaluations was performed. Table 2 shows evaluation results. In Table 2, the iron yield and the results of the final evaluation are shown using evaluation criteria "G (good)," "F (fair)," and "P (poor)" as below.

(Iron Yield)

G: The iron yield was improved. There was no change in iron yield.

P: The iron yield was decreased.

(Final Evaluation)

G: When there was no decrease in iron yield, the average tapped phosphorus concentration was not more than 0.030 mass % and the lime unit consumption was not more than 10 kg/t, or the average tapped phosphorus concentration was not more than 0.015 mass % and the lime unit consumption was not more than 15 kg/t.

F: When there was no decrease in iron yield, the conditions of the average tapped phosphorus concentration and the lime unit consumption indicated above under "G" do not apply.

P: The iron yield was decreased.

TABLE 2

| Example Number | Tapped Phosphorous Concentration (mass %) | Lime Unit Consumption (kg/t) | Iron Yield | Final Evaluation |
|---|---|---|---|---|
| Example 1 | 0.024 | 9.04 | Good | Good |
| Example 2 | 0.018 | 9.44 | Good | Good |
| Example 3 | 0.023 | 9.30 | Good | Good |
| Example 4 | 0.010 | 10.6 | Good | Good |
| Example 5 | 0.010 | 12.6 | Good | Good |
| Comparative Example 1 | 0.024 | 15.4 | Good | Fair |
| Comparative Example 2 | 0.019 | 15.2 | Poor | Poor |
| Comparative Example 3 | 0.023 | 14.8 | Poor | Poor |
| Comparative Example 4 | 0.011 | 26.1 | Good | Fair |
| Comparative Example 5 | 0.009 | 20.1 | Poor | Poor |

Tables 1 to 2 show that, in Examples 1 to 5 in which intermediate slag removal in the second step was performed, compared with Comparative Examples 1 and 4 in which the intermediate slag removal step was not performed, the lime unit consumption could be reduced under all the conditions. Furthermore, it was revealed that, in the method for manufacturing low-phosphorus molten steel in Comparative Examples 1 and 4, in performing the intermediate slag removal, when the slag composition ratio $CaO/(SiO_2+Al_2O_3)$ of slag generated during the melting of a solid iron source and so on was less than 0.25 or more than 0.70, the metal flowed out at the time of removing the slag. On the other hand, it was revealed that, in the method for manufacturing low-phosphorus molten steel in Examples 1 to 5, the slag composition ratio $CaO/(SiO_2+Al_2O_3)$ of slag generated during the melting of a solid iron source and so on was not less than 0.25 and not more than 0.70, and thus it was possible to reduce the lime unit consumption without causing a decrease in iron yield.

As described thus far, Examples each have shown an example in which a unit consumption of lime required to reduce a phosphorus content in molten steel is reduced to thus efficiently manufacture low-phosphorus molten steel by use of an electric furnace. Furthermore, in a different point of view, low-phosphorus molten steel tapped by the method for manufacturing low-phosphorus molten steel according to the present invention has a high oxygen concentration in the molten steel, so that nitrogen absorption hardly occurs. For this reason, the method for manufacturing low-phosphorus molten steel according to the present invention is useful also as a method for obtaining high-purity molten steel. Furthermore, it is also useful to manufacture molten steel having a predetermined component concentration by combining molten steel tapped by this method and molten steel manufactured in a different refining vessel.

INDUSTRIAL APPLICABILITY

The method for manufacturing low-phosphorus molten steel according to the present invention is industrially useful in that a unit consumption of lime required to reduce a phosphorus content in molten steel is reduced, so that low-phosphorus molten steel can be efficiently manufactured by use of an electric furnace.

The invention claimed is:

1. A method for manufacturing low-phosphorus molten steel, the method comprising:

a first step of charging raw material including a solid iron source and, optionally, a molten iron source, and melting and heating the raw material by using electric energy;

a second step of partly or entirely removing slag generated during the melting;

a third step of, after the second step, performing dephosphorization by adding dephosphorization flux; and a fourth step of tapping low-phosphorus molten steel thus refined, wherein a slag composition ratio C/(S+A) of the slag to be removed in the second step is adjusted to be in a range of not less than 0.30 and not more than 0.58, where the slag composition ratio C/(S+A) is determined by dividing a CaO concentration (C) by a sum of an $SiO_2$ concentration(S) and an $Al_2O_3$ concentration (A) on a mass basis in the slag.

2. The method for manufacturing low-phosphorus molten steel according to claim 1, wherein in the third step, the slag composition ratio C/(S+A) is adjusted to be in a range of not less than 0.80 and not more than 2.80.

3. The method for manufacturing low-phosphorus molten steel according to claim 2, wherein, in the fourth step, performing the tapping while the low-phosphorus molten steel is partly left in a furnace, and additionally charging a solid iron source and, optionally, a molten iron source so that molten steel is continuously manufactured.

4. The method for manufacturing low-phosphorus molten steel according to claim 1, wherein, in the fourth step, performing the tapping while the low-phosphorus molten steel is partly left in a furnace, and additionally charging a solid iron source and, optionally, a molten iron source so that molten steel is continuously manufactured.

* * * * *